US010711751B2

(12) United States Patent
Hirabayashi et al.

(10) Patent No.: US 10,711,751 B2
(45) Date of Patent: Jul. 14, 2020

(54) FUEL SUPPLY SYSTEM FOR ENGINE

(71) Applicant: Mazda Motor Corporation, Aki-gun, Hiroshima (JP)

(72) Inventors: Kazunori Hirabayashi, Hiroshima (JP); Hirohisa Shirai, Hiroshima (JP); Hiroshi Komatsu, Hiroshima (JP); Shinichiro Tagami, Hiroshima (JP); Hiroshi Sumimoto, Aki-gun (JP)

(73) Assignee: Mazda Motor Corporation, Aki-gun, Hiroshima (JP)

( * ) Notice: Subject to any disclaimer, the term of this patent is extended or adjusted under 35 U.S.C. 154(b) by 0 days.

(21) Appl. No.: 16/218,870

(22) Filed: Dec. 13, 2018

(65) Prior Publication Data

US 2019/0242348 A1 Aug. 8, 2019

(30) Foreign Application Priority Data

Feb. 2, 2018 (JP) ..... 2018-016965

(51) Int. Cl.
*F02M 55/04* (2006.01)
*F02M 55/02* (2006.01)
(Continued)

(52) U.S. Cl.
CPC ..... *F02M 55/04* (2013.01); *F02M 55/025* (2013.01); *F02M 63/0285* (2013.01);
(Continued)

(58) Field of Classification Search
CPC ..... F02M 2200/85; F02M 2200/315; F02M 55/025; F02M 55/04; F02M 63/0225; F02M 63/0285; F02M 69/465; F02D 2041/3881
See application file for complete search history.

(56) References Cited

U.S. PATENT DOCUMENTS 3,507,263 A * 4/1970 Long ..... F02M 51/02 123/455
5,868,111 A * 2/1999 Augustin ..... F02D 41/22 123/198 D
(Continued)

FOREIGN PATENT DOCUMENTS

DE 102005012165 B4 * 2/2007 ..... F02M 55/04
DE 102008002216 A1 * 10/2009 ..... F02M 63/0295
(Continued)

*Primary Examiner* — John M Zaleskas
(74) *Attorney, Agent, or Firm* — Alleman Hall Creasman & Tuttle LLP

(57) ABSTRACT

A fuel supply system for an engine having a plurality of cylinders is provided, which includes a plurality of fuel injection valves configured to inject fuel into the cylinders in a given order, a first distribution pipe configured to distributingly supply fuel to some of the plurality of fuel injection valves of which the fuel injection orders are not successive in the given order, a second distribution pipe configured to distributingly supply fuel to a remainder of the plurality of fuel injection valves of which the fuel injection orders are not successive in the given order, a fuel pump part configured to discharge fuel, a first feed pipe connecting a first discharge part of the fuel pump part with the first distribution pipe, and a second feed pipe connecting a second discharge part of the fuel pump part and the second distribution pipe.

3 Claims, 2 Drawing Sheets

(51) Int. Cl.
*F02M 69/46* (2006.01)
*F02M 63/02* (2006.01)

(52) U.S. Cl.
CPC ..... *F02M 69/465* (2013.01); *F02M 2200/315* (2013.01); *F02M 2200/85* (2013.01)

(56) References Cited

U.S. PATENT DOCUMENTS 5,954,031 A * 9/1999 Ogiso ..... F02B 75/22 123/447
6,360,722 B1 * 3/2002 Onishi ..... F02M 55/00 123/446
6,397,819 B1 * 6/2002 Rembold ..... F02M 55/025 123/456
6,832,599 B2 * 12/2004 Ibrahim ..... F02M 55/025 123/446
2002/0033167 A1 * 3/2002 Hiraku ..... F02D 41/3845 123/456
2004/0194761 A1 * 10/2004 Ando ..... F02M 55/02 123/456
2005/0126545 A1 * 6/2005 Shafer ..... F02M 59/20 123/495
2006/0000450 A1 * 1/2006 Ricco ..... F02M 47/027 123/447
2006/0000452 A1 * 1/2006 Tokuda ..... F02D 33/006 123/456
2006/0027213 A1 * 2/2006 Nomura ..... F02D 41/38 123/458
2006/0054140 A1 * 3/2006 Shafer ..... F02M 59/20 123/495
2007/0144491 A1 * 6/2007 Ueda ..... F02M 69/465 123/470
2007/0186907 A1 * 8/2007 Otani ..... F01L 1/024 123/446
2008/0066719 A1 * 3/2008 Ricco ..... F02M 47/027 123/445
2009/0145400 A1 * 6/2009 Hanneke ..... F02M 55/025 123/446
2009/0223486 A1 * 9/2009 Weizenauer ..... F02M 55/025 123/447
2010/0147267 A1 * 6/2010 Kato ..... F02M 59/102 123/456
2011/0023818 A1 * 2/2011 Fulton ..... F02M 55/025 123/295
2011/0023833 A1 * 2/2011 Chamarthi ..... F02D 41/3845 123/464
2013/0074804 A1 * 3/2013 McCune ..... F02M 63/027 123/456
2013/0133622 A1 * 5/2013 Ishiki ..... F02M 55/02 123/456
2014/0261293 A1 * 9/2014 Schulz ..... F02B 53/10 123/209
2014/0299102 A1 * 10/2014 McCune ..... F02M 63/027 123/445
2016/0298530 A1 * 10/2016 Schulz ..... F01C 1/22
2016/0298587 A1 * 10/2016 Nakano ..... F02M 51/04
2018/0030886 A1 * 2/2018 Thomassin ..... F02B 53/10

FOREIGN PATENT DOCUMENTS

DE 102017201262 A1 * 9/2017 ..... F02M 63/0285
JP 2007170209 A 7/2007
JP 2014015890 A * 1/2014
WO WO-2016055293 A1 * 4/2016 ..... F02M 63/0285

* cited by examiner

FUEL SUPPLY SYSTEM FOR ENGINE

TECHNICAL FIELD

The present disclosure relates to a fuel supply system which supplies fuel to an engine.

BACKGROUND

It is known that pulsation of fuel pressure influences the injection amount of fuel into a cylinder. As disclosed in JP2007-170209A, it is known that, as a method of reducing the influence of pulsation, the capacity of a storage space where fuel is stored is increased by connecting two fuel distribution pipes each of which distributes fuel to a plurality of fuel injection valves, and a diaphragm is disposed to a coupling part of the fuel distribution pipes.

This conventional technology cannot fully reduce the pulsation transmitted among the plurality of fuel injection valves connected to one of the fuel distribution pipes. The pulsation originating in a fuel injection from one of the fuel injection valves reaches other fuel injection valves through the fuel distribution pipe, before passing through the diaphragm. The fuel injection from the fuel injection valve exposed to the pulsation is influenced by the pulsation, and it may deviate greatly from a target value of the fuel injection amount.

SUMMARY OF THE DISCLOSURE

One purpose of the present disclosure is to provide a fuel supply system having a structure capable of reducing influence of pulsation transmitted among a plurality of fuel injection valves.

According to one aspect of the present disclosure, a fuel supply system for an engine configured to supply fuel to the engine having a plurality of cylinders is provided. The system includes a plurality of fuel injection valves configured to inject fuel into the plurality of cylinders in a given order, a fuel distribution part having a first distribution pipe configured to distributingly supply fuel to a first fuel injection valve group comprised of some of the plurality of fuel injection valves of which fuel injection orders are not successive in the given order, and a second distribution pipe configured to distributingly supply fuel to a second fuel injection valve group comprised of a remainder of the plurality of fuel injection valves of which the fuel injection orders are not successive in the given order, a fuel pump part configured to discharge fuel, a first feed pipe connecting a first discharge part of the fuel pump part with the first distribution pipe, and a second feed pipe connecting a second discharge part of the fuel pump part and the second distribution pipe. The first feed pipe and the second feed pipe form independent fuel feed paths from the first and second discharge parts of the fuel pump part to the first distribution pipe and the second distribution pipe, respectively.

According to this structure, the first distribution pipe is connected to the plurality of fuel injection valves of the first fuel injection valve group so as to distributingly supply fuel to the first fuel injection valve group. Thus, pulsation resulting from the fuel injection by the plurality of the fuel injection valves of the first fuel injection valve group is transmitted to the first distribution pipe. Similarly, the second distribution pipe is connected to the plurality of fuel injection valves of the second fuel injection valve group so as to distributingly supply fuel to the second fuel injection valve group. Thus, the pulsation resulting from the fuel injection by the plurality of the fuel injection valves of the second fuel injection valve group is transmitted to the second distribution pipe. However, since the fuel injection orders are not successive in the first fuel injection valve group, the time intervals between the fuel injections by the first fuel injection valve group become longer so that a sufficient period of time to satisfactorily attenuate the pulsation is obtained. Similarly, since the fuel injection orders are not successive in the second fuel injection valve group, the time intervals between the fuel injections by the second fuel injection valve group become longer so that a sufficient period of time to satisfactorily attenuate the pulsation is obtained. Therefore, the influence of the pulsation transmitted among the plurality of fuel injection valves connected to the first and second distribution pipes is reduced.

The first distribution pipe receives the supply of fuel through the first feed pipe, i.e., the first distribution pipe communicates with the first feed pipe, and the pulsation inside the first distribution pipe may be transmitted to the first feed pipe. However, the second feed pipe forms the fuel feed path independently from the fuel feed path formed by the first feed pipe, and thus, the pulsation transmitted to the first feed pipe from the first distribution pipe is not transmitted to the second feed pipe.

Similarly, the second distribution pipe receives the supply of fuel through the second feed pipe, i.e., the second distribution pipe communicates with the second feed pipe, and the pulsation inside the second distribution pipe may be transmitted to the second feed pipe. However, the first feed pipe forms the fuel feed path independently from the fuel feed path formed by the second feed pipe, and thus, the pulsation transmitted to the second feed pipe from the second distribution pipe is not transmitted to the first feed pipe.

The fuel distribution part may include a plurality of distribution branch pipes forming fuel distribution paths to the first fuel injection valve group. The first feed pipe may be connected to an intermediate position of the first distribution pipe in extending directions of the first distribution pipe. The plurality of distribution branch pipes may be connected with the first distribution pipe so as to be symmetrical with respect to the intermediate position at which the first feed pipe is connected.

According to this structure, since the plurality of distribution branch pipes are connected with the first distribution pipe at symmetrical positions in the extending directions of the first distribution pipe, the influence of the pulsation originating in the supply of the fuel to the first distribution pipe from the first feed pipe appear substantially equally in the plurality of the distribution branch pipes. The influence of the pulsation to the first fuel injection valves to which the fuel is distributed through the distribution branch pipes also become substantially equal, and as a result, control of the first group of fuel injection valves considering the influences of the pulsation becomes easier.

The fuel supply system may further include a first pressure reducing valve configured to be opened when pressure in the first distribution pipe exceeds a given pressure limit, a first return pipe configured to return excess fuel in the first distribution pipe when the first pressure reducing valve is opened, a second pressure reducing valve configured to be opened when a pressure in the second distribution pipe exceeds a given pressure limit, a second return pipe configured to return excess fuel in the second distribution pipe when the second pressure reducing valve is opened, and a coupling part coupled to an upstream end of the first return pipe and a downstream end of the second return pipe, and attached to the first distribution pipe.

According to this structure, since the first return pipe and the second return pipe are coupled to the coupling part, one path for returning the excess fuel when the pressures in the first distribution pipe and the second distribution pipe exceed the given pressure limits is formed. A worker can handle the first return pipe and the second return pipe as a single pipe member, and thus, the first return pipe and the second return pipe are piped easily.

As described above, since the fuel injection orders are not successive in the first and second fuel injection valve groups, a design engineer can set the injection order of the plurality of the fuel injection valves such that the first pressure reducing valve and the second pressure reducing valve do not open simultaneously. Therefore, even in a case where the first return pipe and the second return pipe are coupled to the coupling part and the paths to which the excess fuel is guided are collected into a single path, the excess fuel flows smoothly.

The first distribution pipe and the second distribution pipe may extend in series with each other in lined-up directions of the plurality of cylinders. The coupling part may be disposed at an end of the first distribution pipe closer to the second distribution pipe than a first feed coupling part at which the first feed pipe is coupled to the first distribution pipe.

According to this structure, since the first distribution pipe and the second distribution pipe extend in series with each other in the lined-up directions of the plurality of cylinders, the fuel distribution part extends to align in the lined-up directions so that it does not need a large arrangement area in directions crossing the lined-up directions. Since the coupling part is disposed at an end of the first distribution pipe closer to the second distribution pipe than the first feed coupling part at which the first feed pipe is coupled to the first distribution pipe, the worker can carry out the piping of the first return pipe between the first feed coupling part where the first feed pipe couples to the first distribution pipe and the coupling part where the second feed pipe is coupled to the second distribution pipe. This means that the first return pipe is arranged near the first feed pipe and the second feed pipe. Therefore, the worker can carry out the piping work of the first return pipe efficiently at the close position to the first and second feed pipes.

The second return pipe may extend from an end of the second distribution pipe farther from the first distribution pipe than a second feed coupling part at which the second feed pipe is coupled to the second distribution pipe.

According to this structure, since the second return pipe extends from the end of the second distribution pipe farther from the first distribution pipe than the second feed coupling part, the coupling part where the second return pipe couples to the second distribution pipe does not come too close to the coupling part where the first return pipe and the second return pipe couples to each other. That is, both ends of the second return pipe are coupled to the coupling part of the first distribution pipe and to the second distribution pipe, respectively, at positions appropriately separated from each other. Therefore, the worker can easily couple the second return pipe to the second distribution pipe and the coupling part.

The second return pipe extends from the end of the second distribution pipe, and similarly, the first return pipe is coupled to the coupling part at an end of the first distribution pipe. Therefore, the design engineer can harmonize the geometry and structure of the first distribution pipe with those of the second distribution pipe.

DETAILED DESCRIPTION OF THE DISCLOSURE

Figure 1:
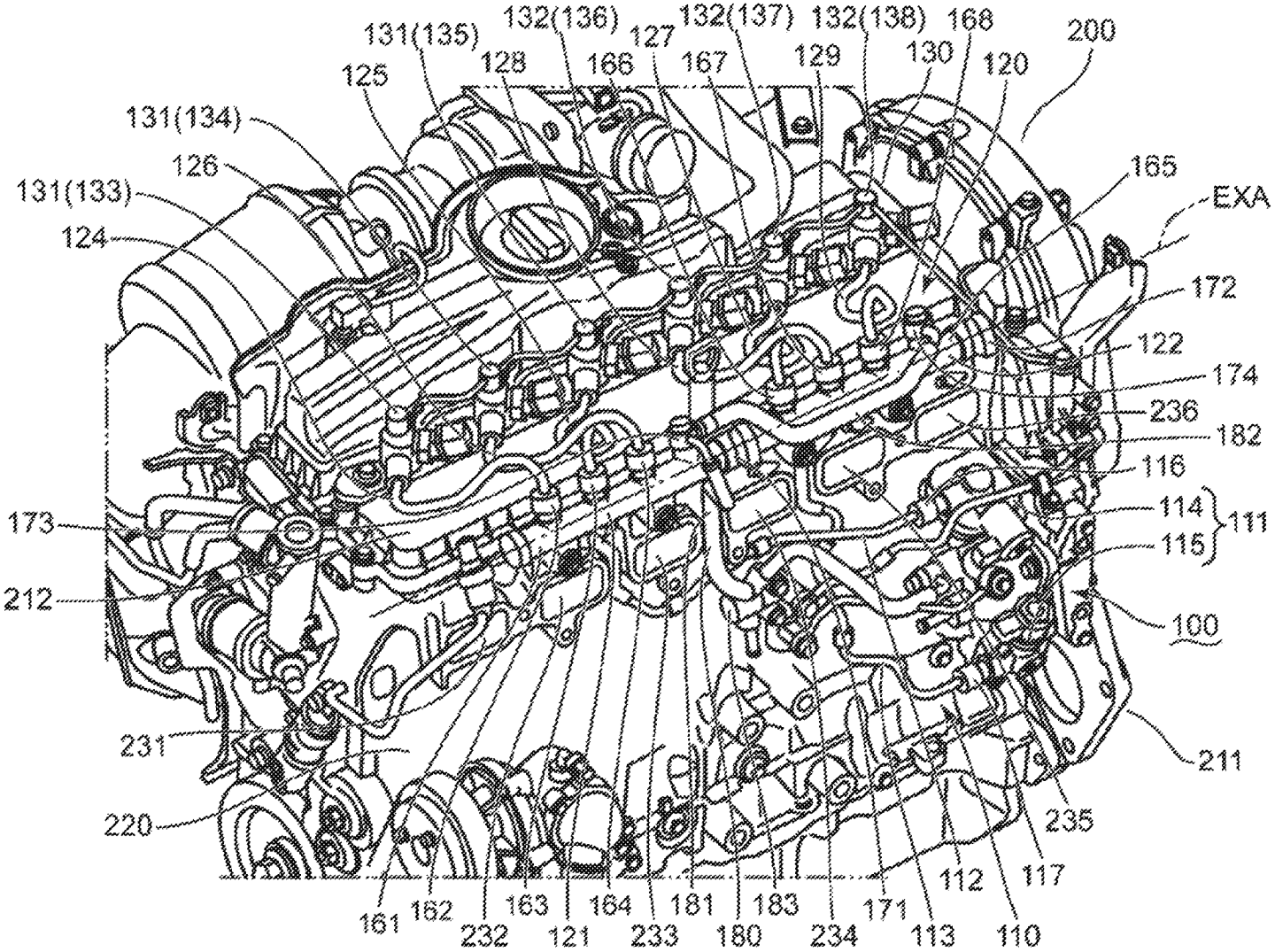
FIG. 1 is a perspective view schematically illustrating an engine with a fuel supply system which supplies fuel to the engine.

FIG. 1 is a perspective view schematically illustrating an engine 200 with a fuel supply system 100 which supplies fuel to the engine 200. The engine 200 will be described with reference to FIG. 1, prior to the description of the fuel supply system 100. The directional terms, such as "front," "rear," "right," "left," "up," and "down" are used only for clarifying the description, and should not be interpreted restrictively.

<Engine>

The engine 200 is an in-line 6-cylinder engine. The engine 200 includes a cylinder block 211 and a cylinder head 212. Six cylinders each having a center axis extending in the up-and-down directions and opening upwardly are disposed in the cylinder block 211. The cylinder head 212 closes the opening ends of the six cylinders which are lined up in the front-and-rear directions.

The engine 200 further includes six pistons (not illustrated) which reciprocate in the up-and-down directions inside the six cylinders, respectively, a crankshaft (not illustrated) which outputs the reciprocation of the six pistons as rotation on a given rotational axis, and a coupling mechanism (not illustrated) which couples the crankshaft to each of the six pistons. The crankshaft extends in the front-and-rear directions, below the six pistons. The coupling mechanism may include connecting rods, piston rods, and a cross-head. Common engine designs and technologies for vehicles may be applied to the structure of the engine 200. Therefore, the principle of this embodiment is not limited to the particular structure of the engine 200.

The cylinder block 211 of the engine 200 includes a left side surface 220, and six intake ports 231-236 protruded to the left from the left side surface 220 (i.e., a direction perpendicular to the lined-up directions and the extending directions of the six cylinders). The left side surface 220 is used for attachment of the fuel supply system 100. The six intake ports 231-236 are used for feeding air into the six cylinders inside the cylinder block 211.

The intake port 231 is formed foremost among the intake ports 231-236. The intake port 231 forms an intake path to the foremost cylinder. The intake port 232 is located rearward of the intake port 231, and forms an intake path to the cylinder rearward of the cylinder into which air is fed from the intake port 231. The intake port 233 is located rearward of the intake port 232, and forms an intake path to the cylinder rearward of the cylinder into which air is fed from the intake port 232. The intake port 234 is located rearward of the intake port 233, and forms an intake path to the cylinder rearward of the cylinder into which air is fed from the intake port 233. The intake port 235 is located rearward of the intake port 234, and forms an intake path to the cylinder rearward of the cylinder into which air is fed from the intake port 234. The intake port 236 is located rearmost among the intake ports 231-236. The intake port 236 forms an intake path to the rearmost cylinder.

Between the intake ports 232 and 233, between the intake ports 233 and 234, and between the intake ports 234 and 235, gaps extending in the up-and-down directions are formed. These gaps are used for piping of the fuel supply system 100. The structure of the fuel supply system 100 is described briefly below.

<Structure of Fuel Supply System>

The fuel supply system 100 has a part which sends out fuel to the engine 200, a part which distributes the fuel to the six cylinders of the engine 200, and a part which injects the fuel to the six cylinders. The fuel supply system 100 has, as the part which sends out the fuel to the engine 200, a fuel feed part 110 which forms a feed path of the fuel along the left side surface 220 of the engine 200. The fuel supply system 100 has, as the part which distributes the fuel to the six cylinders, a fuel distribution part 120 extending in the front-and-rear directions (i.e., the cylinder lined-up directions) above the intake ports 231-236. The fuel supply system 100 has, as the part which injects fuel to the six cylinders, a valve group 130 comprised of a plurality of fuel injection valves attached to an upper surface of the cylinder head 212. The fuel feed part 110 supplies fuel to the fuel distribution part 120. The fuel distribution part 120 distributes the fuel to the valve group 130. The valve group 130 injects the fuel to the six cylinders.

The fuel feed part 110 which sends out fuel to the valve group 130 through the fuel distribution part 120 includes a fuel pump part 111 fixed to a rear part of the left side surface 220 of the engine 200, and two feed pipes connected to the fuel pump part 111. In the following description, one of the two feed pipes is referred to as "the first feed pipe 112," and the other feed pipe is referred to as "the second feed pipe 113." The fuel pump part 111 sucks fuel from a fuel tank (not illustrated), and discharges the sucked fuel to the first feed pipe 112 and the second feed pipe 113. The first feed pipe 112 forms a first feed path which guides fuel forward and upward. Similar to the first feed pipe 112, the second feed pipe 113 forms a second feed path which guides fuel forward and upward. The second feed path is independent from the first feed path.

The fuel pump part 111 which discharges fuel to the first feed pipe 112 and the second feed pipe 113 includes two pumps 114 and 115 which are aligned in the vertical directions. The upper pump 114 includes a discharge part 116 from which the fuel sucked by the fuel pump part 111 from the fuel tank is discharged. The first feed pipe 112 is connected to the discharge part 116. The lower pump 115 includes a discharge part 117 from which the fuel sucked by the fuel pump part 111 from the fuel tank is discharged. The second feed pipe 113 is connected to the discharge part 117.

The second feed pipe 113 extends upward and forward from the discharge part 117 of the lower pump 115, and is inserted into the gap formed between the intake ports 234 and 235. An upper end of the second feed pipe 113 is connected to the fuel distribution part 120. Similar to the second feed pipe 113, the first feed pipe 112 extends upward and forward from the discharge part 116 of the upper pump 114 so that it intersects three-dimensionally with the second feed pipe 113, and is inserted into the gap formed between the intake ports 233 and 232. An upper end of the first feed pipe 112 is connected to the fuel distribution part 120 at a first feed coupling part forward of a second feed coupling part in which the upper end of the second feed pipe 113 is connected to the fuel distribution part 120.

The fuel distribution part 120 stores fuel temporarily, and distributes the stored fuel to the valve group 130. The fuel distribution part 120 has, as the part which stores fuel temporarily, a first distribution pipe 121 extending substantially horizontally above the intake ports 231, 232, and 233, and a second distribution pipe 122 disposed rearward of the first distribution pipe 121. The fuel distribution part 120 has, as the part which distributes the stored fuel to the valve group 130, six distribution branch pipes 124-129 extending from the first distribution pipe 121 and the second distribution pipe 122 to the valve group 130. The fuel stored in the first distribution pipe 121 and the second distribution pipe 122 are distributed to the valve group 130 through the distribution branch pipes 124-129.

The first distribution pipe 121 and the second distribution pipe 122 extend in series, the cylinder lined-up directions (i.e., in the front-and-rear directions), on the left of the cylinder head 212 (i.e., above the cylinder block 211). Each of the first distribution pipe 121 and the second distribution pipe 122 is a substantially cylindrical pipe member extending substantially horizontally. The first feed pipe 112 extending from the upper pump 114 is connected to a lower part of a circumferential wall of the first distribution pipe 121. Similarly, the second feed pipe 113 extending from the lower pump 115 is connected a lower part of a circumferential wall of the second distribution pipe 122. The fuel sent out from the fuel pump part 111 through the first feed pipe 112 and the second feed pipe 113 is temporarily stored in an interior space (hereinafter, referred to as "the first storage space") formed by the first distribution pipe 121, and an interior space (hereinafter, referred to as "the second storage space") formed by the second distribution pipe 122. The second storage space is separated from the first storage space.

The first distribution pipe 121 forming the first storage space is used for distributing fuel to three of the cylinders. The second distribution pipe 122 disposed rearward of the first distribution pipe 121 is used for distributing fuel to the remaining three cylinders disposed rearward of the three cylinders to which fuel is distributed by the first distribution pipe 121.

An extended axis EXA which substantially coincides with the center axis of the first distribution pipe 121 and the second distribution pipe 122 is illustrated in FIG. 1. The extended axis EXA extends in the lined-up directions of the six cylinders, and is substantially parallel to the cylinder row formed by the six cylinders. The first distribution pipe 121 and the second distribution pipe 122 extend parallel to the extended axis EXA.

The first distribution pipe 121 includes a substantially cylindrical main pipe 161 extending parallel to the extended axis EXA, and three distribution connectors 162, 163, and 164 which project upwardly from the main pipe 161. The main pipe 161 is a part which forms the first storage space. The distribution connectors 162, 163, and 164 are connected to the distribution branch pipes 124, 125, and 126 which are connected to a part of the valve group 130, respectively.

In addition to the distribution branch pipes 124, 125, and 126, the first feed pipe 112 extending from the upper pump 114 is connected to a lower part of a circumferential surface of the main pipe 161 of the first distribution pipe 121, and fuel discharged from the upper pump 114 flows into the main pipe 161 through the first feed pipe 112. The fuel pressure inside the main pipe 161 increases as the upper pump 114 sends out the fuel. Therefore, the main pipe 161 is designed to store high-pressure fuel. The high-pressure fuel in the main pipe 161 flows out of the distribution connectors 162, 163, and 164.

The distribution connector 162 is formed foremost among the distribution connectors 162, 163, and 164. The distribution connector 164 is formed rearmost among the distribution connectors 162, 163, and 164. The distribution connector 163 is formed between the distribution connectors 162 and 164. The first feed coupling part at which the distribution connector 163 and the first feed pipe 112 are connected with the main pipe 161 is formed in an imaginary plane (not illustrated) perpendicular to the extended axis EXA at an intermediate position of the first distribution pipe 121 in the longitudinal directions. The distribution connectors 162 and 164 are symmetrical with respect to the imaginary plane.

The distribution branch pipes 124, 125, and 126 are connected to the distribution connectors 162, 163, and 164, respectively, to form distribution paths of fuel from the first distribution pipe 121 to the valve group 130. Other distribution branch pipes 127, 128, and 129 are connected to the second distribution pipe 122 to form distribution paths of fuel from the second distribution pipe 122 to the valve group 130. The second distribution pipe 122 has substantially the same shape and structure as the first distribution pipe 121. Therefore, the above and following description about the shape and structure of the first distribution pipe 121 is also applicable to those of the second distribution pipe 122.

The second distribution pipe 122 includes a main pipe 165 extending parallel to the extended axis EXA, rearward of the main pipe 161 of the first distribution pipe 121, and three distribution connectors 166, 167, and 168. The main pipe 165 extends in series to the main pipe 161 of the first distribution pipe 121. A lower part of a circumferential surface of the main pipe 165 is connected to the second feed pipe 113 extending from the lower pump 115, and fuel discharged from the lower pump 115 flows through the second feed pipe 113 into the second storage space formed by the main pipe 165. The fuel pressure in the main pipe 165 increases as the lower pump 115 sends out the fuel. Therefore, the main pipe 165 is designed to store high-pressure fuel. The high-pressure fuel inside the main pipe 165 flows out of the distribution connectors 166, 167, and 168.

The distribution connector 166 is formed foremost among the distribution connectors 166, 167, and 168. The distribution connector 168 is formed rearmost among the distribution connectors 166, 167, and 168. The distribution connector 167 is formed between the distribution connectors 166 and 168. The distribution branch pipes 127, 128, and 129 are connected to the distribution connectors 166, 167, and 168, respectively, to form distribution paths of fuel to the valve group 130. The second feed coupling part at which the distribution connector 167 and the second feed pipe 113 are connected with the main pipe 165 is formed in an imaginary plane (not illustrated) perpendicular to the extended axis EXA at an intermediate position of the second distribution pipe 122 in the longitudinal directions. The distribution connectors 166 and 168 are symmetrical with respect to the imaginary plane.

The valve group 130 receives fuel through the six distribution branch pipes 124-129 extended from the six distribution connectors 162-164, and 166-168. The plurality of fuel injection valves used as the valve group 130 are divided into a first fuel injection valve group 131 connected to the distribution branch pipes 124, 125, and 126 extended from the distribution connectors 162, 163, and 164 of the first distribution pipe 121, and a second fuel injection valve group 132 connected to the distribution branch pipes 127-129 extended from the distribution connectors 166, 167, and 168 of the second distribution pipe 122.

In the following description, the three fuel injection valves of the first fuel injection valve group 131 are referred to as "the first fuel injection valves 133, 134, and 135," and the three fuel injection valves of the second fuel injection valve group 132 are referred to as "the second fuel injection valves 136, 137, and 138." The first fuel injection valves 133, 134, and 135 and the second fuel injection valves 136, 137, and 138 are fixed to the upper surface of the cylinder head 212, and inject fuel to the six cylinders disposed below the first fuel injection valves 133, 134, and 135 and the second fuel injection valves 136, 137, and 138, respectively. Timings of fuel injections from the first fuel injection valves 133, 134, and 135 and the second fuel injection valves 136, 137, and 138 to the six cylinders are controlled by an Electronic Control Unit or ECU (not illustrated), and the first fuel injection valves 133, 134, and 135 and the second fuel injection valves 136, 137, and 138 inject fuel to the six cylinders in a given order.

The first fuel injection valve 133 is disposed foremost among the valves in the valve group 130. The first fuel injection valve 133 is connected to the distribution branch pipe 124 extended from the distribution connector 162. The first fuel injection valve 134 rearward of the first fuel injection valve 133 is connected to the distribution branch pipe 126 extended from the distribution connector 164. The first fuel injection valve 135 rearward of the first fuel injection valve 134 is connected to the distribution branch pipe 125 extended from the distribution connector 163 between the distribution connectors 162 and 164 so that the distribution branch pipe 125 intersects three-dimensionally with the distribution branch pipe 126. The second fuel injection valve 136 rearward of the first fuel injection valve 135 is connected to the distribution branch pipe 128 extended from the distribution connector 167. The second fuel injection valve 137 rearward of the second fuel injection valve 136 is connected to the distribution branch pipe 127 extended from the distribution connector 166 forward of the distribution connector 167 so that the distribution branch pipe 127 intersects three-dimensionally with the distribution branch pipe 128. The second fuel injection valve 138 rearmost among the valves in the valve group 130 is connected to the distribution branch pipe 129 extended from the distribution connector 168 rearward of the distribution connector 167.

The fuel pump part 111 discharges fuel at an amount exceeding that of the fuel supplied to the valve group 130 through the distribution branch pipes 124-129 to set the fuel in the first distribution pipe 121 and the second distribution pipe 122 at a high pressure. As a result, the fuel is injected powerfully from the valve group 130. As the result of supplying the fuel of the amount beyond the fuel injection amount to the first distribution pipe 121 and the second distribution pipe 122 from the fuel pump part 111, the fuel pressure in the first distribution pipe 121 and the second distribution pipe 122 may exceed a given pressure limit. Therefore, the fuel supply system 100 has a pressure adjusting mechanism for reducing the pressure in the first distribution pipe 121 and the second distribution pipe 122. The pressure adjusting mechanism of the fuel supply system 100 is described below.

The pressure adjusting mechanism causes the fuel to flow out of the fuel distribution part 120 so that the fuel pressure in the fuel distribution part 120 is reduced, and guides downwardly the fuel flowing out of the fuel distribution part 120. The fuel supply system 100 includes, as the part which causes the fuel to flow out of the fuel distribution part 120 and reduces the fuel pressure in the fuel distribution part 120, two valves attached to the fuel distribution part 120, and two projections projected upwardly from the fuel distribution part 120. One of the two valves is a first pressure reducing valve 171 attached to the first distribution pipe 121, and the other valve is a second pressure reducing valve 172 attached to the second distribution pipe 122. One of the two projections is a coupling part 173 projected upwardly from a circumferential wall of the first distribution pipe 121, and the other projection is an outflow part 174 projected upwardly from a circumferential wall of the second distribution pipe 122. The fuel supply system 100 includes, as the part which guides downwardly the fuel flowing out of the fuel distribution part 120, a guide pipe part 180. The first pressure reducing valve 171, the second pressure reducing valve 172, the coupling part 173, the outflow part 174, and the guide pipe part 180 are described below.

The first pressure reducing valve 171 is attached to a rear end of the main pipe 161 of the first distribution pipe 121. The first pressure reducing valve 171 is a mechanical valve which communicates the first storage space of the first distribution pipe 121 with a channel formed by the coupling part 173 projected upwardly from a rear end part of a circumferential wall of the main pipe 161 of the first distribution pipe 121, at a location rearward of the distribution connector 164, and closes the communicating part of the first distribution pipe 121 and the coupling part 173, according to the fuel pressure in the first distribution pipe 121. Similarly, the second pressure reducing valve 172 is a mechanical valve which communicates the second storage space of the second distribution pipe 122 with a channel formed by the outflow part 174 projected upwardly from a rear end part of a circumferential wall of the main pipe 165 of the second distribution pipe 122, at a location rearward of the distribution connector 168, and closes the communicating part of the second distribution pipe 122 and the outflow part 174, according to the fuel pressure in the second distribution pipe 122.

The guide pipe part 180 guides downwardly the fuel which flows out of the second distribution pipe 122 when the second pressure reducing valve 172 opens and the fuel which flows out of the first distribution pipe 121 when the first pressure reducing valve 171 opens. The guide pipe part 180 includes a first return pipe 181 extended downwardly from the coupling part 173, a second return pipe 182 connected to the coupling part 173 and the outflow part 174, and a connecting member 183 disposed below the first distribution pipe 121 and the second distribution pipe 122. The first return pipe 181 and the second return pipe 182 are connected through the coupling part 173. The first return pipe 181 is connected to the connecting member 183 to form a guide path of the fuel from the coupling part 173 to the connecting member. The second return pipe 182 forms a guide path of the fuel from the outflow part 174 to the coupling part 173. The connecting member 183 is connected to a pipe member (not illustrated) connected with the fuel tank. That is, the connecting member 183 is used for connecting the first return pipe 181 with the pipe member connected with the fuel tank.

<Operation of Fuel Supply System>

Operation of the fuel supply system 100 is described briefly below.

When the fuel pump part 111 operates, the fuel in the fuel tank is sucked by the fuel pump part 111 and reaches the fuel pump part 111. The fuel pump part 111 discharges the fuel from the discharge parts 116 and 117. The fuel is guided by the first feed pipe 112 and the second feed pipe 113 extended from the discharge parts 116 and 117, to the first distribution pipe 121 and the second distribution pipe 122, respectively. The fuel is then temporarily stored inside the first distribution pipe 121 and the second distribution pipe 122. Since the fuel pump part 111 discharges a larger amount of fuel than the injection amount of fuel from the valve group 130, the fuel pressures in the first distribution pipe 121 and the second distribution pipe 122 are higher.

The high-pressure fuel in the first distribution pipe 121 and the second distribution pipe 122 is injected to the six cylinders inside the engine 200, when the valve group 130 opens. The first fuel injection valves 133, 134, and 135, and the second fuel injection valves 136, 137, and 138 are opened at different timings under a control of the ECU. When the first fuel injection valves 133, 134, and 135 are opened, the fuel in the first distribution pipe 121 flows into the first fuel injection valves 133, 134, and 135 through the distribution branch pipes 124, 126, and 125, and is injected from the first fuel injection valves 133, 134, and 135 to three cylinders, respectively. Similarly, when the second fuel injection valves 136, 137, and 138 are opened, the fuel in the second distribution pipe 122 flows into the second fuel injection valves 136, 137, and 138 through the distribution branch pipes 128, 127, and 129, and is injected from the second fuel injection valves 136, 137, and 138 to three cylinders, respectively.

As described above, since the fuel exceeding the injection amount of the fuel from the first fuel injection valves 133, 134, and 135 and the second fuel injection valves 136, 137, and 138 is discharged from the fuel pump part 111, the fuel pressure in the first distribution pipe 121 and the second distribution pipe 122 may exceed the given pressure limit. If the fuel pressure in the first distribution pipe 121 and the second distribution pipe 122 exceeds the given pressure limit, the first pressure reducing valve 171 and the second pressure reducing valve 172 are opened. When the first pressure reducing valve 171 is opened, the first storage space of the first distribution pipe 121 communicates with the first return pipe 181. Here, the fuel in the first storage space of the first distribution pipe 121 flows out of the coupling part 173, and then flows into the first return pipe 181. As a result, the fuel pressure in the first storage space decreases. When the second pressure reducing valve 172 is opened, the second storage space of the second distribution pipe 122 communicates with the second return pipe 182. Here, the fuel in the second storage space of the second distribution pipe 122 flows out of the outflow part 174, and then flows into the second return pipe 182. As a result, the fuel pressure in the second storage space decreases. The fuel flowing into the second return pipe 182 from the second storage space sequentially passes through the second return pipe 182 and the coupling part 173, and then flows into the first return pipe 181.

The fuel flowing into the first return pipe 181 through the outflow part 174, the second return pipe 182, and the coupling part 173 from the second storage space, and the fuel flowing into the first return pipe 181 through the coupling part 173 from the first storage space flows downwardly along the first return pipe 181, and then reaches the connecting member 183 below the first distribution pipe 121 and the second distribution pipe 122. The fuel then flows into the pipe member connected with the fuel tank from the connecting member 183 to return to the fuel tank.

<Control for Reducing Pulsation Inside Fuel Distribution Part>

As described above, the first feed pipe 112 piped next to the first return pipe 181 which guides fuel to the connecting member 183, is connected to the first distribution pipe 121 extended from the upper pump 114 of the fuel pump part 111. The second distribution pipe 122 disposed rearward of the first distribution pipe 121 is connected to the second feed pipe 113 extended from the lower pump 115. Since the second feed path formed by the second feed pipe 113 is independent from the first feed path formed by the first feed pipe 112, and the second distribution pipe 122 is separated from the first distribution pipe 121, pulsation originated in the fuel pump part 111 is not propagated between the first distribution pipe 121 and the second distribution pipe 122. However, pulsation may be caused by the valve group 130. A control which reduces the pulsation originated in the valve group 130 is described below.

Figure 2:
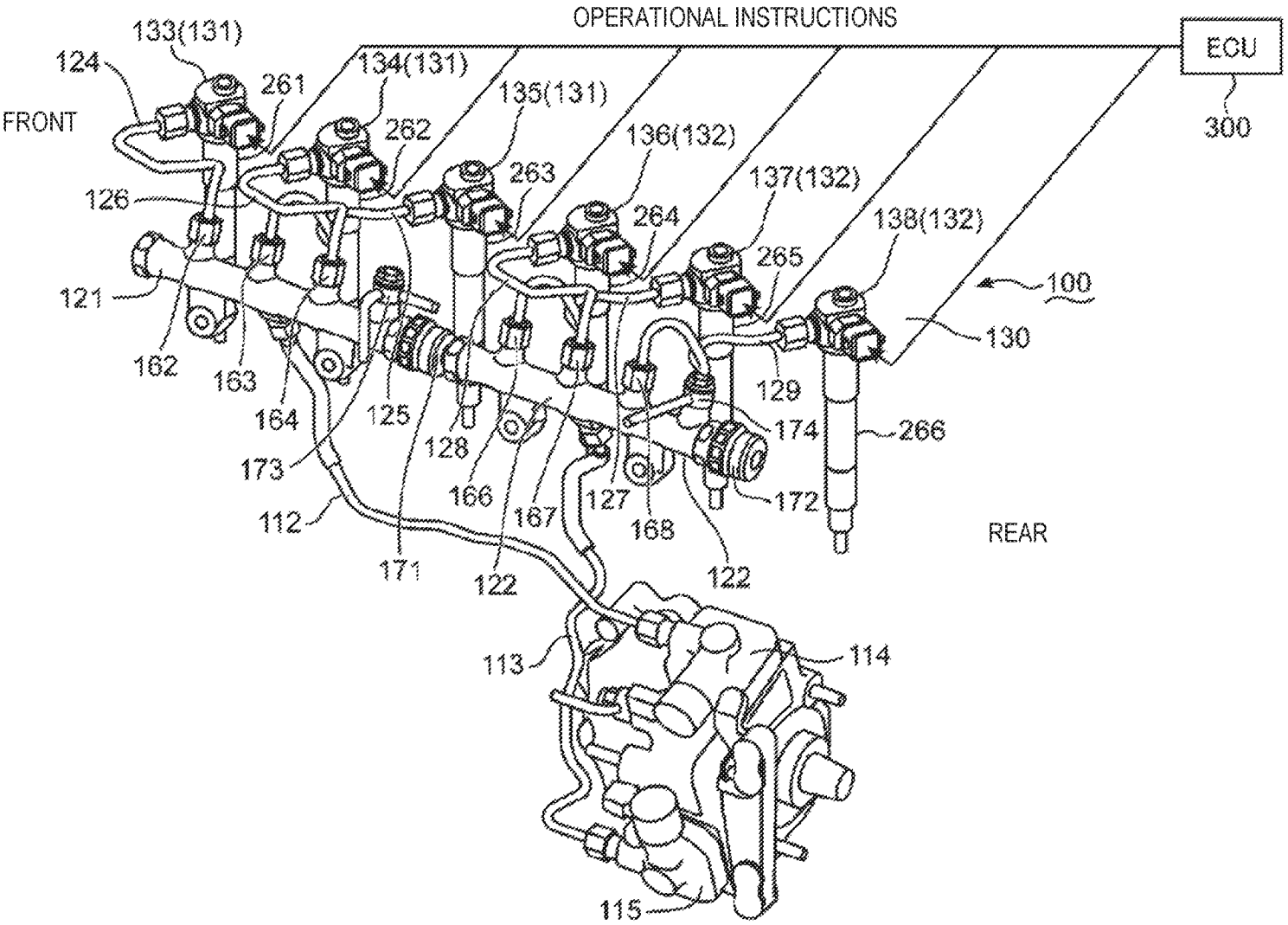
FIG. 2 is a perspective view schematically illustrating the fuel supply system.

FIG. 2 is a perspective view schematically illustrating the fuel supply system 100. Referring to FIGS. 1 and 2, the control which reduces the pulsation originated in the valve group 130 is described.

FIG. 2 illustrates, in addition to the fuel supply system 100, first to sixth cylinders 261-266 as the six cylinders described above. FIG. 2 also illustrates an ECU 300 which controls the valve group 130.

The first fuel injection valve 133 injects fuel to the first cylinder 261 below the first fuel injection valve 133, under the control of the ECU 300. The first fuel injection valve 134 injects fuel to the second cylinder 262 below the first fuel injection valve 134, under the control of the ECU 300. The first fuel injection valve 135 injects fuel to the third cylinder 263 below the first fuel injection valve 135, under the control of the ECU 300. The second fuel injection valve 136 injects fuel to the fourth cylinder 264 below the second fuel injection valve 136, under the control of the ECU 300. The second fuel injection valve 137 injects fuel to the fifth cylinder 265 below the second fuel injection valve 137, under the control of the ECU 300. The second fuel injection valve 138 injects fuel to the sixth cylinder 266 below the second fuel injection valve 138, under the control of the ECU 300.

The first fuel injection valves 133, 134, and 135 are connected with the first distribution pipe 121 through the distribution branch pipes 124, 126, and 125. Therefore, the pulsation originated in the operation of the first fuel injection valves 133, 134, and 135 is propagated to the first distribution pipe 121. The second fuel injection valves 136, 137, and 138 rearward of the first fuel injection valves 133, 134, and 135 are connected with the second distribution pipe 122 through the distribution branch pipes 128, 127, and 129. Therefore, the pulsation originated in the operation of the second fuel injection valves 136, 137, and 138 is propagated to the second distribution pipe 122.

The ECU 300 determines the injection timing of fuel from the valve group 130 so that the pulsation propagated to the first distribution pipe 121 and the second distribution pipe 122 is reduced. The ECU 300 outputs operational instructions to the valve group 130 so that the fuel injections of the first fuel injection valve group 131 (i.e., the first fuel injection valves 133, 134, and 135) connected to the first distribution pipe 121 are not performed successively, and the fuel injections of the second fuel injection valve group 132 (i.e., the second fuel injection valves 136, 137, and 138) connected to the second distribution pipe 122 are not performed successively. The valve group 130 operates according to the operational instructions. The following Table 1 illustrates one example of the fuel injection order of the valve group 130.

TABLE 1

| Fuel Injection Order | Target Fuel Injection Valve |
|---|---|
| First | First Injection Valve 133 |
| Second | Second Injection Valve 137 |
| Third | First Injection Valve 135 |
| Fourth | Second Injection Valve 138 |
| Fifth | First Injection Valve 134 |
| Sixth | Second Injection Valve 136 |

The first fuel injection valves 133, 134, and 135 (i.e., the valve group connected to the first distribution pipe 121) inject by odd injection order (i.e., first, third, and fifth injections). The second fuel injection valves 136, 137, and 138 (i.e., valve group connected to the second distribution pipe 122) inject by even injection order (i.e., second, fourth, and sixth injections).

<Effects such as Reduction of Pulsation in Fuel Distribution Part>

The injection order of the first fuel injection valves 133, 134, and 135 is the odd number order, and thereby the injections are not successive. The first fuel injection valve 133 first injects fuel among the valves in the valve group 130, as illustrated in Table 1. The first fuel injection valve 134 injects fuel at the fifth injection among the valves in the valve group 130. The first fuel injection valve 135 injects fuel as the third injection among the valves in the valve group 130. The second fuel injection valve 137 injects fuel between the timing of fuel injection by the first fuel injection valve 133 and the timing of fuel injection by the first fuel injection valve 135. The second fuel injection valve 138 injects fuel between the timing of fuel injection by the first fuel injection valve 135 and the timing of fuel injection by the first fuel injection valve 134. Therefore, the time interval between the fuel injections by the first fuel injection valves 133 and 135, and the time interval between the fuel injections by the first fuel injection valves 135 and 134 become longer. The pulsation resulting from the operation of the first fuel injection valve 133 is sufficiently attenuated during the long period until the first fuel injection valve 135 injects fuel, thereby hardly influencing the amount of fuel injected from the first fuel injection valve 135. Further, the pulsation resulting from the operation of the first fuel injection valve 135 is sufficiently attenuated during the long period until the first fuel injection valve 134 injects fuel, thereby hardly influencing the amount of fuel injected from the first fuel injection valve 134.

Since the second fuel injection valves 137, 138, and 136 which inject fuel after the first fuel injection valves 133, 135, and 134 are connected to the second distribution pipe 122 disposed separating from the first distribution pipe 121, they are not influenced by the pulsation originated in the operation of the first fuel injection valves 133, 135, and 134. As illustrated in Table 1, the second fuel injection valve 137 injects fuel as the second injection in the valve group 130. The second fuel injection valve 138 injects fuel as the fourth injection in the valve group 130. The second fuel injection valve 136 injects fuel lastly in the valve group 130. That is, the injection order of the second fuel injection valves 137, 138, and 136 is the even number order, and thereby the injections are not successive.

The first fuel injection valve 135 injects fuel between the timing of the fuel injection by the second fuel injection valve 137 and the timing of the fuel injection by the second fuel injection valve 138. The first fuel injection valve 134 injects fuel between the timing of the fuel injection by the second fuel injection valve 138 and the timing of the fuel injection by the second fuel injection valve 136. Therefore, the time interval between the fuel injections by the second fuel injection valves 137 and 138, and the time interval between the fuel injections by the second fuel injection valve 138 and 136 become longer. The pulsation resulting from the operation of the second fuel injection valve 137 is sufficiently attenuated during the long period until the second fuel injection valve 138 injects fuel, thereby hardly influencing the amount of fuel injected from the second fuel injection valve 138. The pulsation resulting from the operation of the second fuel injection valve 138 is sufficiently attenuated during the long period until the second fuel injection valve 136 injects fuel, thereby hardly influencing the amount of fuel injected from the second fuel injection valve 136.

The second distribution pipe 122 which distributes fuel to the second fuel injection valves 136, 137, and 138 is disposed so as to be separated from the first distribution pipe 121 which distributes fuel to the first fuel injection valves 133, 134, and 135. While the first distribution pipe 121 receives the supply of fuel through the first feed path which the first feed pipe 112 forms, the second distribution pipe 122 receives the fuel through the second feed path which the second feed pipe 113 forms independently from the first feed path. As a result, the pulsation resulting from operation of the fuel pump part 111 which discharges the fuel to the first feed path and the second feed path is not propagated between the first distribution pipe 121 and the second distribution pipe 122.

Since the fuel distribution part 120 is divided into the first distribution pipe 121 and the second distribution pipe 122 in order to prevent the propagation of pulsation, the plurality of pipe members to which the excess fuel in the first distribution pipe 121 and the second distribution pipe 122 is guided are needed. Therefore, the fuel supply system 100 has the first return pipe 181 and the second return pipe 182 as the pipe members. Since both the first return pipe 181 and the second return pipe 182 are connected with the coupling part 173 projected from the main pipe 161 of the first distribution pipe 121, a worker can handle the first return pipe 181 and the second return pipe 182 as a single pipe member, and can assemble the fuel supply system 100 efficiently.

Since the first return pipe 181 and the second return pipe 182 are connected through the coupling part 173, the paths for returning the excess fuel in the first distribution pipe 121 and the second distribution pipe 122 are collected into a single line. In this case, when the first pressure reducing valve 171 and the second pressure reducing valve 172 are opened simultaneously, smooth fuel flows inside the first return pipe 181 and the second return pipe 182 may be obstructed. However, since the fuel injection order is not successive in each of the first fuel injection valve group 131 and the second fuel injection valve group 132, and the first fuel injection valves 133, 135, and 134 and the second fuel injection valves 137, 138, and 136 inject fuel alternately, the fuel pressures in the first distribution pipe 121 and the second distribution pipe 122 will not exceed the pressure limit simultaneously. That is, the first pressure reducing valve 171 and the second pressure reducing valve 172 do not open simultaneously. Therefore, the excess fuel in the first distribution pipe 121 and the second distribution pipe 122 can return to the fuel tank smoothly through the first return pipe 181 and the second return pipe 182.

The coupling part 173 used for connection of the first return pipe 181 and the second return pipe 182 is attached to the rear end of the first distribution pipe 121. Since the first feed pipe 112 forming the first feed path (the fuel feed path from the upper pump 114) is connected at an intermediate position of the first distribution pipe 121 in the longitudinal directions, the coupling part 173 is located near the second distribution pipe 122, closer than the first feed coupling part in which the first feed pipe 112 is connected with the first distribution pipe 121. Similarly, since the second feed pipe 113 forming the second feed path (fuel feed path from the lower pump 115) is connected at an intermediate position of the second distribution pipe 122 in the longitudinal directions, the coupling part 173 is located near the first distribution pipe 121, closer than the second feed coupling part in which the second feed pipe 113 is connected with the second distribution pipe 122. In addition, the first return pipe 181 connected with the coupling part 173, the first feed pipe 112 connected with the first distribution pipe 121, and the second feed pipe 113 connected with the second distribution pipe 122 extend downwardly. Therefore, these pipe members are disposed close of each other. As a result, since the worker can carry out the piping work of these pipe members almost simultaneously, the efficiency of the piping work of these pipe members can be increased.

The second return pipe 182 is connected with the outflow part 174 disposed at the rear end part of the second distribution pipe 122 to which the second feed pipe 113 is connected. Since the outflow part 174 is located farther from the first distribution pipe 121 than the second feed coupling part in which the second feed pipe 113 is connected with the second distribution pipe 122, the distance between the outflow part 174 and the coupling part 173 disposed at the rear end part of the first distribution pipe 121 is not too short. Therefore, the worker can easily connect the second return pipe 182 to the outflow part 174 and the coupling part 173.

The coupling part 173 and the outflow part 174 are the parts projected from the rear end parts of the main pipes 161 and 165 of the first distribution pipe 121 and the second distribution pipe 122. In addition to the similarity of the layouts of the coupling part 173 and the outflow part 174, the layout of the distribution connectors 166, 167, and 168 of the second distribution pipe 122 and the connecting position of the second feed pipe 113 to the second distribution pipe 122 are also common or similar to the layout of the distribution connectors 162, 163, and 164 of the first distribution pipe 121 and the connecting position of the first feed pipe 112 to the first distribution pipe 121. Therefore, a design engineer can harmonize the geometry and structure of the first distribution pipe 121 with those of the second distribution pipe 122.

Regarding the layout of the distribution connectors 162-164 of the first distribution pipe 121, and the distribution connectors 166-168 of the second distribution pipe 122, the distribution connectors 163 and 167 are disposed at intermediate positions of the first distribution pipe 121 and the second distribution pipe 122 in the longitudinal directions. The distribution connectors 162 and 164 are symmetrically disposed with respect to the imaginary plane perpendicular to the extended axis EXA at the intermediate position of the first distribution pipe 121. Similarly, the distribution connectors 166 and 168 are symmetrically disposed with respect to the imaginary plane perpendicular to the extended axis EXA at the intermediate position of the second distribution pipe 122. Therefore, the distribution connectors 162-164 of the first distribution pipe 121 and the distribution connectors 166-168 of the second distribution pipe 122 are symmetrical with respect to the intermediate positions of the first distribution pipe 121 and the second distribution pipe 122. As a result of the symmetrical arrangement of the distribution connectors 162-164 of the first distribution pipe 121 and the distribution connectors 166-168 of the second distribution pipe 122, the influences of the pulsation originated in the supply of the fuel to the first distribution pipe 121 from the first feed pipe 112 appear substantially equally in the distribution connectors 162 and 164. Therefore, the influences of the pulsation to the first fuel injection valves 133 and 134 to which the fuel is distributed through the distribution connectors 162 and 164 also become substantially equal. Similarly, the influence of the pulsation originated in the supply of fuel to the second distribution pipe 122 from the second feed pipe 113 appears substantially equally in the distribution connectors 166 and 168 and the second fuel injection valves 137 and 138 to which the fuel is distributed through the connectors 166 and 168. As a result, the differences in the fuel injection characteristic between the first fuel injection valves 133 and 134 and between the second fuel injection valves 137 and 138 are reduced. Therefore, the control of the fuel injection from the valve group 130 becomes easier.

Since the engine 200 has six cylinders in the above embodiment, the fuel supply system 100 is formed so as to inject the fuel into the six cylinders. However, the fuel supply system may also be formed so as to inject the fuel into 5 or fewer cylinders and 7 or more cylinders.

In the above embodiment, the fuel distribution part 120 which distributes the fuel to the six cylinders is divided into the first distribution pipe 121 and the second distribution pipe 122. However, the fuel distribution part may also be divided into three or more distribution pipes.

In the above embodiment, the three distribution paths (fuel feed paths to the valve group 130) are formed from each of the first distribution pipe 121 and the second distribution pipe 122. However, the number of distribution paths extended from each distribution pipe may be two or, four or more.

In the above embodiment, the damping effect of the pulsation originated in the fuel injections from the first fuel injection valves 133-135 to which the fuel is distributed from the first distribution pipe 121 is exclusively obtained from the injection order of the fuel from the first fuel injection valves 133-135, and the connection relation between the first fuel injection valve group 131 and the branch pipes 124, 125, and 126. Similarly, the damping effect of the pulsation originated in the injections of the fuel from the second fuel injection valves 136-138 to which the fuel is distributed from the second distribution pipe 122 is exclusively obtained from the injection order of the fuel from the second fuel injection valves 136-138, and the connection relation between the second fuel injection valve group 132 and the branch pipes 127, 128, and 129. Therefore, the design engineer may adopt various piping structures for the fuel feed path(s) upstream of the fuel distribution part 120.

In the above embodiment, the pressure adjusting mechanism for adjusting the fuel pressures in the first distribution pipe 121 and the second distribution pipe 122 is described in detail. However, the design engineer may adopt any pressure adjusting mechanism used for known fuel supply systems.

The principle of the above embodiment is used suitably for various vehicles.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof, are therefore intended to be embraced by the claims.

DESCRIPTION OF REFERENCE CHARACTERS

100 Fuel Supply System
112 First Feed Pipe
113 Second Feed Pipe
121 First Distribution Pipe
122 Second Distribution Pipe
124-129 Distribution Branch Pipe
131 First Fuel Injection Valve Group
132 Second Fuel Injection Valve Group
133-135 First Injection Valve (Some of Plurality of Fuel Injection Valves)
136-138 Second Injection Valve (Remainder of Fuel Injection Valves)
171 First Pressure Reducing Valve
172 Second Pressure Reducing Valve
173 Coupling Part
181 First Return Pipe
182 Second Return Pipe
261 First Cylinder (One of Plurality of Cylinders)
262 Second Cylinder (One of Plurality of Cylinders)
263 Third Cylinder (One of Plurality of Cylinders)
264 Fourth Cylinder (One of Plurality of Cylinders)
265 Fifth Cylinder (One of Plurality of Cylinders)
266 Sixth Cylinder (One of Plurality of Cylinders)

What is claimed is:

1. A fuel supply system for an engine, configured to supply fuel to the engine having a plurality of cylinders, comprising:

a plurality of fuel injection valves configured to inject fuel into the plurality of cylinders in a given order;

a fuel distribution part having a first distribution pipe configured to distributingly supply fuel to a first fuel injection valve group comprised of some of the plurality of fuel injection valves of which fuel injection orders are not successive in the given order, and a second distribution pipe configured to distributingly supply fuel to a second fuel injection valve group comprised of a remainder of the plurality of fuel injection valves of which the fuel injection orders are not successive in the given order;

a fuel pump part configured to discharge fuel;

a first feed pipe connecting a first discharge part of the fuel pump part with the first distribution pipe;

a first pressure reducing valve configured to be opened when a pressure in the first distribution pipe exceeds a given pressure limit;

a first return pipe configured to return excess fuel in the first distribution pipe when the first pressure reducing valve is opened;

a second feed pipe connecting a second discharge part of the fuel pump part and the second distribution pipe;

a second pressure reducing valve configured to be opened when a pressure in the second distribution pipe exceeds the given pressure limit;

a second return pipe configured to return excess fuel in the second distribution pipe when the second pressure reducing valve is opened; and a coupling part coupled to an upstream end of the first return pipe and a downstream end of the second return pipe, and attached to the first distribution pipe, wherein the first feed pipe and the second feed pipe form independent fuel feed paths from the first and second discharge parts of the fuel pump part to the first distribution pipe and the second distribution pipe, respectively, wherein the first distribution pipe and the second distribution pipe extend in series with each other in lined-up directions of the plurality of cylinders, and wherein the coupling part is disposed at an end of the first distribution pipe closer to the second distribution pipe than a first feed coupling part at which the first feed pipe is coupled to the first distribution pipe.

2. The fuel supply system of claim 1, wherein the fuel distribution part includes a plurality of distribution branch pipes forming fuel distribution paths to the first fuel injection valve group, wherein the first feed pipe is connected to an intermediate position of the first distribution pipe in extending directions of the first distribution pipe, and wherein the plurality of distribution branch pipes are connected with the first distribution pipe so as to be symmetrical with respect to the intermediate position at which the first feed pipe is connected.

3. The fuel supply system of claim 1, wherein the second return pipe extends from an end of the second distribution pipe farther from the first distribution pipe than a second feed coupling part at which the second feed pipe is coupled to the second distribution pipe.

* * * * *